US010885866B2

(12) United States Patent
Hua et al.

(10) Patent No.: US 10,885,866 B2
(45) Date of Patent: Jan. 5, 2021

(54) TURN-ON VOLTAGE SUPPLYING CIRCUIT AND METHOD, DEFECT ANALYZING METHOD AND DISPLAY DEVICE

(71) Applicants: BOE TECHNOLOGY GROUP CO., LTD., Beijing (CN); BEIJING BOE DISPLAY TECHNOLOGY CO., LTD., Beijing (CN)

(72) Inventors: Ming Hua, Beijing (CN); Xinyu Hu, Beijing (CN); Liwei Zhu, Beijing (CN); Luqiang Guo, Beijing (CN); Zhiming Meng, Beijing (CN); Yunfei Wang, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 11 days.

(21) Appl. No.: 15/326,749

(22) PCT Filed: Jul. 6, 2016

(86) PCT No.: PCT/CN2016/088881
§ 371 (c)(1),
(2) Date: Jan. 17, 2017

(87) PCT Pub. No.: WO2017/117950
PCT Pub. Date: Jul. 13, 2017

(65) Prior Publication Data

US 2018/0308447 A1 Oct. 25, 2018

(30) Foreign Application Priority Data

Jan. 4, 2016 (CN) ..... 2016 1 0004052

(51) Int. Cl.
*G09G 3/36* (2006.01)
*G09G 3/00* (2006.01)
*G09G 3/20* (2006.01)

(52) U.S. Cl.
CPC ..... *G09G 3/3696* (2013.01); *G09G 3/006* (2013.01); *G09G 3/2007* (2013.01);
(Continued)

(58) Field of Classification Search
CPC ..... G09G 3/3696; G09G 3/2007; G09G 3/36; G09G 3/3688
(Continued)

(56) References Cited

U.S. PATENT DOCUMENTS

2005/0041002 A1* 2/2005 Takahara ..... G09G 3/3241 345/76
2007/0146395 A1 6/2007 Lee
(Continued)

FOREIGN PATENT DOCUMENTS

CN 1992790 A 7/2007
CN 101126846 A 2/2008
(Continued)

OTHER PUBLICATIONS

First Office Action for Chinese Application No. 201610004052.5, dated Jul. 7, 2017, 10 Pages.
(Continued)

*Primary Examiner* — Amr A Awad
*Assistant Examiner* — Jonathan G Cooper
(74) *Attorney, Agent, or Firm* — Brooks Kushman P.C.

(57) ABSTRACT

The present application provides a turn-on voltage supplying circuit and method, a defect analysis method and a display device. The turn-on voltage supplying circuit includes a voltage supplying unit and a switching unit. The voltage supplying unit is configured to provide turn-on voltages,
(Continued)

values of which being within a predetermined range, to the M stages of gate driving circuits respectively in the case that the M stages of gate driving circuits are in a normal operation state, or provide corresponding turn-on voltages to the gate driving circuits in the case that the gate driving circuits are subject to a defect analysis process. M is an integer greater than 1. When the gate driving circuits are subject to the defect analysis process, the voltage supplying unit comprises variable resistors connected between a reference turn-on voltage outputting terminal and the turn-on voltage inputting terminals of the gate driving circuits.

18 Claims, 2 Drawing Sheets

(52) U.S. Cl.
CPC ..... *G09G 3/3677* (2013.01); *G09G 3/3688* (2013.01); *G09G 2310/027* (2013.01); *G09G 2330/12* (2013.01)

(58) Field of Classification Search
USPC ..... 345/690
See application file for complete search history.

(56) References Cited

U.S. PATENT DOCUMENTS

| | | | | |
|---|---|---|---|---|
| 2008/0122776 | A1 | 5/2008 | Ishii et al. | |
| 2012/0105499 | A1* | 5/2012 | Nakamura | G09G 3/3291 345/690 |
| 2016/0026047 | A1 | 1/2016 | Chen | |
| 2016/0118000 | A1* | 4/2016 | Kim | G09G 3/3688 345/691 |

FOREIGN PATENT DOCUMENTS

| | | | |
|---|---|---|---|
| CN | 101825813 | A | 9/2010 |
| CN | 101872093 | A | 10/2010 |
| CN | 102237050 | A | 11/2011 |
| CN | 104076544 | A | 10/2014 |
| CN | 105489181 | A | 4/2016 |
| JP | 2000293139 | A | 10/2000 |

OTHER PUBLICATIONS

International Search Report and Written Opinion for Application No. PCT/CN2016/088881, dated Oct. 10, 2016, 10 Pages.

* cited by examiner

TURN-ON VOLTAGE SUPPLYING CIRCUIT AND METHOD, DEFECT ANALYZING METHOD AND DISPLAY DEVICE

CROSS-REFERENCE TO RELATED APPLICATIONS

This application is the U.S. national phase of PCT Application No. PCT/CN2016/088881 filed on Jul. 6, 2016, which claims priority to Chinese Patent Application No. 201610004052.5 filed on Jan. 4, 2016, the disclosures of which are incorporated in their entirety by reference herein.

TECHNICAL FIELD

The present disclosure relates to a technical field of displaying, and specifically relates to a turn-on voltage supplying circuit and method, a defect analyzing method, and a display device.

BACKGROUND

In an industry of Thin Film Transistor-Liquid Crystal Display (TFT-LCD), a gate driving circuit in a large or medium sized display device is typically bonded to an array substrate in a Chip On Flex (COF) manner. On the liquid crystal display panel, a resistance of a fan-out region corresponding to each COF is different, especially in the case that the COF is designed with non-uniform spacings, differences of the resistances of the respective fan-out regions are more evident. As shown in FIG. 1, a turn-on voltage supplying circuit in the gate driving circuit in related arts supplies the turn-on voltages to multiple stages of gate driving circuits directly through a reference turn-on voltage VGH. A distance of signal transmission in the gate driving circuits is long due to an oversized display product, and signals are attenuated, such that the turn-on voltages for the gate driving circuits are under-powered, causing that the gate driving circuits are possibly not turned on completely. As a result, a color gradient phenomenon may undesirably appear on a gray scale image displayed by the display device.

Additionally, in the related arts, when the gate driving circuit is subject to a defect analysis process, a direct current may be usually applied to the gate driving circuit, which causes inconvenience. In some large or medium sized display devices, a horizontal striped gray-scale flaw named H-Block might occur, and the turn-on voltages for the gate driving circuits may jump somewhere in the COF, causing segment differences of colors in the gray-scale image. In a process of debugging, resistors on a Printed Circuit Board (PCB) have to be welded repeatedly, which is a heavy workload, and such repeated operations are easily to damage products and introduce difficulties to the defect analysis process.

SUMMARY

An object of the present disclosure is to provide a turn-on voltage supplying circuit and method, a defect analyzing method, and a display device, so as to improve a uniformity of colors in a displayed image adversely affected by an attenuation of the turn-on voltages of gate driving circuits due to a long signal transmission distance, and during a process of analyzing a defect of the gate driving circuit, it is able to reduce the heavy workload for repeating to weld resistors, prevent the product from being damaged by the repeated operations, and facilitate the defect analysis process.

In one aspect, the present disclosure provides in some embodiments a turn-on voltage supplying circuit for providing turn-on voltages to M stages of gate driving circuits, wherein M is an integer greater than 1. The turn-on voltage supplying circuit includes: a voltage supplying unit configured to provide the turn-on voltages, values of which being within a predetermined range, to the M stages of gate driving circuits respectively in the case that the M stages of gate driving circuits are in a normal operation state, or provide corresponding turn-on voltages to the gate driving circuits in the case that the gate driving circuits are subject to a defect analysis process; and a switching unit connected between the voltage supplying unit and turn-on voltage inputting terminals of the gate driving circuits, and configured to control the voltage supplying unit to provide or not provide the turn-on voltages to the turn-on voltage inputting terminals of the gate driving circuits. Wherein in the case that the gate driving circuits are subject to the defect analysis process, the voltage supplying unit includes variable resistors connected between a reference turn-on voltage outputting terminal and the turn-on voltage inputting terminals of the gate driving circuits.

In actual implementation, in the case that the M stages of gate driving circuits are in the normal operation state, the voltage supplying unit provides the turn-on voltages, values of which being equal to each other, to the M stages of gate driving circuits respectively.

In actual implementation, the voltage supplying unit includes a first resistor unit and a second resistor unit. The first resistor unit includes M constant resistors, and the second resistor unit includes M variable resistors. The first one of the M constant resistors is connected between the reference turn-on voltage outputting terminal and a turn-on voltage inputting terminal of a first stage of gate driving circuit among the M stages of gate driving circuits. An m-th one of the M constant resistors is connected between a turn-on voltage inputting terminal of an (m−1)-th stage of gate driving circuit among the M stages of gate driving circuits and a turn-on voltage inputting terminal of an m-th stage of gate driving circuit among the M stages of gate driving circuits, wherein m is an integer greater than 1 and equal to or less than M. An n-th one of the M variable resistors is connected between the reference turn-on voltage outputting terminal and a turn-on voltage inputting terminal of an n-th stage of gate driving circuit among the M stages of gate driving circuits, wherein n is an integer greater than 0 and equal to or less than M.

In actual implementation, in the case that the M stages of gate driving circuits are in the normal operation state, resistance values of the M variable resistors are all 0 ohm, and resistance values of the M constant resistors are set to enable values of turn-on voltages inputted via the turn-on voltage inputting terminals of the M stages of gate driving circuits to be within the predetermined range.

In actual implementation, in the case that the n-th stage of gate driving circuit is subject to the defect analysis process, a resistance value of a corresponding n-th one of the M variable resistors is adjusted, and a turn-on voltage of the n-th stage of gate driving circuit corresponding to a resistance value of the n-th variable resistor is detected, so as to determine a cause of a defect.

In actual implementation, the turn-on voltage supplying circuit further includes a voltage regulating unit connected between the switching unit and the turn-on voltage inputting terminals of the gate driving circuits, and configured to regulate the turn-on voltages.

In actual implementation, the turn-on voltages are capable of enabling the gate driving circuits to operate normally.

In actual implementation, resistance values of the M constant resistors are distributed in a successively decreasing manner according to a sequence of the M constant resistors.

In actual implementation, the voltage regulating unit is an operational amplification circuit.

The present disclosure further provides a turn-on voltage supplying method for the above turn-on voltage supplying circuit. The method includes: providing, by the voltage supplying unit, the turn-on voltages, values of which being within a predetermined range, to the M stages of gate driving circuits respectively in the case that the M stages of gate driving circuits are in a normal operation state, or providing, by the voltage supplying unit, corresponding turn-on voltages to the gate driving circuits by adjusting resistance values of corresponding variable resistors in the case that the gate driving circuits are subject to a defect analysis process, wherein M is an integer greater than 1; and controlling, by the switching unit, to control the voltage supplying unit to provide or not provide the turn-on voltages to the turn-on voltage inputting terminals of the gate driving circuits.

In actual implementation, the above turn-on voltage supplying method further includes regulating the turn-on voltages by a voltage regulating unit.

The present disclosure further provides a turn-on voltage supplying method for the above turn-on voltage supplying circuit. The method includes: setting resistance values of the constant resistors and the variable resistors, to provide the turn-on voltages, values of which being within the predetermined range, to the M stages of gate driving circuits respectively in the case that the M stages of gate driving circuits are in the normal operation state, or providing the corresponding turn-on voltages to the gate driving circuits in the case that the gate driving circuits are subject to the defect analysis process, wherein M is an integer greater than 1.

In actual implementation, the turn-on voltage supplying method specifically includes: in the case that the M stages of gate driving circuits are in the normal operation state, setting each of resistance values of the M variable resistors to be 0 ohm, and setting resistance values of the M constant resistors to enable values of turn-on voltages inputted via the turn-on voltage inputting terminals of the M stages of gate driving circuits to be equal.

In actual implementation, the turn-on voltage supplying method specifically includes: in the case that the n-th stage of gate driving circuit is subject to the defect analysis process, adjusting a resistance value of a corresponding n-th one of the M variable resistors, and detecting a turn-on voltage of the n-th stage of gate driving circuit corresponding to a resistance value of the n-th variable resistor, so as to determine a cause of a defect, wherein n is an integer greater than 0 and equal to or less than M.

The present disclosure further provides a defect analyzing method for analyzing a defect of a gate driving circuit by the above turn-on voltage supplying circuit. The method includes: in the case that the gate driving circuit is subject to the defect analysis process, detecting a turn-on voltage corresponding to the gate driving circuit by adjusting a resistance value of a variable resistor connected between the reference turn-on voltage outputting terminal and the turn-on voltage inputting terminal of the gate driving circuit, so as to determine a cause of the defect.

The present disclosure further provides a display device including: M stages of gate driving circuits, wherein M is an integer greater than 1; and the turn-on voltage supplying circuit according to any one of claims 1-6. The turn-on voltage supplying circuit is configured to provide the turn-on voltages to the M stages of gate driving circuits.

Comparing with the related arts, the present disclosure provides the circuit and the turn-on voltage supplying method, the defect analyzing method, and the display device, in which when the gate driving circuits are in the normal operation state, the voltage supplying unit may provide the turn-on voltages, values of which being substantially equal, to the M stages of gate driving circuits, and may enable the colors in a displayed image on the display panel to be uniform. In addition, the voltage supplying unit may further provide corresponding turn-on voltages to the gate driving circuits when the gate driving circuits are subject to the defect analysis process. The switching unit may control the voltage supplying unit to provide or not provide the turn-on voltages of the gate driving circuits to the turn-on voltage inputting terminals of the gate driving circuits. Thus, it is able to facilitate the defect analysis process and improve the efficiency of the defect analysis.

BRIEF DESCRIPTION OF THE DRAWINGS

In order to illustrate the technical solutions of the present disclosure or the related art in a clearer manner, the drawings desired for the present disclosure or the related art will be described hereinafter briefly. Obviously, the following drawings merely relate to some embodiments of the present disclosure, and based on these drawings, a person skilled in the art may obtain the other drawings without any creative effort. The following figures are not necessarily depicted in actual scales, which merely intends to illustrate the principle of the present disclosure.

DETAILED DESCRIPTION

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

Unless otherwise defined, any technical or scientific term used herein shall have the common meaning understood by a person of ordinary skills. Such words as "first" and "second" used in the specification and claims are merely used to differentiate different components rather than to represent any order, number or importance. Similarly, such words as "one" or "a" are merely used to represent the existence of at least one member, rather than to limit the number thereof. Such words as "connect" or "connected to" may include electrical connection, direct or indirect, rather than to be limited to physical or mechanical connection. Such words as "on", "under", "left" and "right" are merely used to represent relative position relationship, and when an absolute position of the object is changed, the relative position relationship will be changed too.

Figure 1:
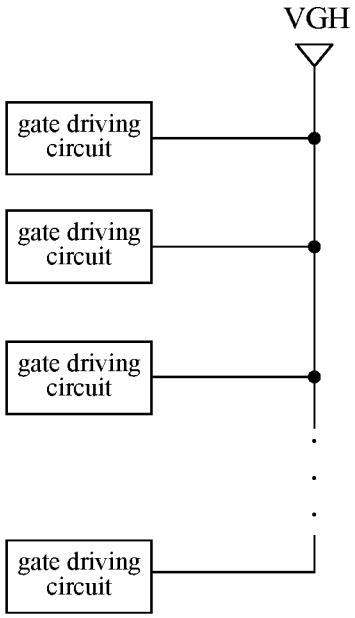
FIG. 1 is a structural schematic diagram of a turn-on voltage supplying circuit in the related arts.
Figure 2:
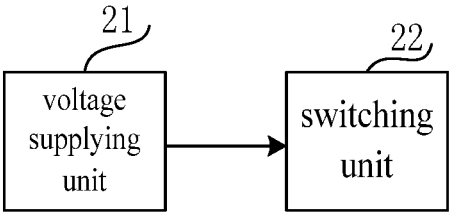
FIG. 2 is a structural block diagram of a turn-on voltage supplying circuit according to embodiments of the present disclosure.

As shown in FIG. 2, the present disclosure provides in some embodiments a turn-on voltage supplying circuit configured to supply the turn-on voltages to M stages of gate driving circuits (not shown in FIG. 2), where M is an integer greater than 1.

The turn-on voltage supplying circuit includes a voltage supplying unit 21 and a switching unit 22. The voltage supplying unit 21 is configured to provide the turn-on voltages, values of which being within a predetermined range, to the M stages of gate driving circuits respectively when the M stages of gate driving circuits are in a normal operation state, or provide corresponding turn-on voltages to the gate driving circuits when the gate driving circuits are subject to a defect analysis process. The switching unit 22 is connected between the voltage supplying unit 21 and turn-on voltage inputting terminals of the gate driving circuits, and configured to control the voltage supplying unit 21 to provide or not provide the turn-on voltages to the turn-on voltage inputting terminals of the gate driving circuits.

When the gate driving circuits are subject to the defect analysis process, the voltage supplying unit 21 includes adjustable resistors (not shown in FIG. 2) connected between a reference turn-on voltage outputting terminal and the turn-on voltage inputting terminals of the gate driving circuits (not shown in Figure).

In actual implementations, the adjustable resistors may be arranged between the reference turn-on voltage outputting terminal and the turn-on voltage inputting terminals of some of the M stages of the gate driving circuits in which defects arise more frequently. As a result, it is able to detect corresponding turn-on voltages by adjusting resistance values of the adjustable resistors, such that the defect analysis may be performed on the stages of gate driving circuits in which defects arise more frequently. Alternatively, as shown in the following embodiments, an adjustable resistor may be arranged between the turn-on voltage inputting terminal of each of the M stages of gate driving circuits and the reference turn-on voltage outputting terminal.

The turn-on voltage is capable of enabling the corresponding gate driving circuit to operate normally.

The present disclosure provides in some embodiments the turn-on voltage supplying circuit including the voltage supplying unit. When the M stages of gate driving circuits are in the normal operation state, the voltage supplying unit provides the M stages of gate driving circuits with the turn-on voltages that are substantially equal, so as to improve a uniformity of colors in a displayed image adversely affected by an attenuation of the turn-on voltages of the gate driving circuits due to a long signal transmission distance. In addition, during a process of analyzing a defect of a gate driving circuit, a corresponding turn-on voltage may be provided to the gate driving circuit by the voltage supplying unit, and the switching unit controls the voltage supplying unit to provide or not provide the turn-on voltage of the gate driving circuit to the turn-on voltage inputting terminal of the gate driving circuit. As a result, during the defect analysis process, it is able to reduce the heavy workload for repeating to weld resistors, prevent the product from being damaged by the repeated operations, and facilitate the defect analysis process.

Optionally, when the M stages of gate driving circuits are in the normal operation state, the voltage supplying unit provides the turn-on voltages, values of which being equal to each other, to the M stages of gate driving circuits respectively.

In the above optional case, the turn-on voltages provided by the voltage supplying unit to all of the gate driving circuits are equal, so as to prevent the phenomenon of gray-scale flaw in the displayed image from occurring to the maximum extent and improve uniformity of the colors in the displayed image.

Specifically, the voltage supplying unit may include a first resistor unit and a second resistor unit.

The first resistor unit includes M constant resistors, and the second resistor unit includes M variable resistors.

A first one of the M constant resistors is connected between the reference turn-on voltage outputting terminal for outputting the reference turn-on voltage and a turn-on voltage inputting terminal of a first stage of gate driving circuit among the M stages of gate driving circuits.

An m-th one of the M constant resistors is connected between a turn-on voltage inputting terminal of an (m−1)-th stage of gate driving circuit among the M stages of gate driving circuits and a turn-on voltage inputting terminal of an m-th stage of gate driving circuit among the M stages of gate driving circuits, wherein m is an integer greater than 1 and equal to or less than M.

An n-th one of the M variable resistors is connected between the reference turn-on voltage outputting terminal and a turn-on voltage inputting terminal of an n-th stage of gate driving circuit among the M stages of gate driving circuits, wherein n is an integer greater than 0 and equal to or less than M.

In case that the voltage supplying unit includes the first resistor unit and the second resistor unit, the switching unit includes M switching modules, each of which is connected between a corresponding one of the M variable resistors and the turn-on voltage inputting terminal of a corresponding stage of gate driving circuit among the M stages of gate driving circuits.

In actual implementation, for the large or medium sized display device, the M stages of gate driving circuits are typically welded to the array substrate in the COF manner.

When the M stages of gate driving circuits are in the normal operation state, resistance values of the M variable resistors are all 0 ohm, and resistance values of the M constant resistors are set to enable values of turn-on voltages inputted via the turn-on voltage inputting terminals of the M stages of gate driving circuits to be within the predetermined range. Thus, the corresponding turn-on voltage for each of the M stages of gate driving circuits is controlled separately, so as to improve the uniformity of colors in the grey-scale image adversely affected by an attenuation of the turn-on voltages of the gate driving circuits due to a long turning-on voltage signal transmission distance, may be solved, and prevent the phenomenon of gray-scale flaw in the displayed image from occurring.

In actual implementations, the resistances of the constant resistors may be determined according to values obtained in a development cycle. For example, resistance values of the M constant resistors decrease successively according to a sequence of the M constant resistors, which is especially applicable to an oversized display product, so as to improve the uniformity of colors in the displayed gray-scale image.

When the n-th stage of gate driving circuit is subject to the defect analysis process, a resistance value of a corresponding n-th one of the M variable resistors is adjusted, and a turn-on voltage of the n-th stage of gate driving circuit corresponding to a resistance value of the n-th variable resistor is detected, so as to determine a cause of a defect.

In the defect analysis process, the resistances of corresponding variable resistors may be adjusted as desired. In addition, the switching unit may control each of the M stages of gate driving circuits to connect to or disconnected from the corresponding one of the variable resistors, thereby significantly improving capabilities of defect inspection and control adjustment.

Comparing with cases in the related arts in which the defect inspection is performed by inconveniently replacing resistors in the PCB with new ones, and such repeated operations are easily to damage PCB and introduce difficulties to the defect analysis process, the present disclosure provides in some embodiments the turn-on voltage supplying circuit, in the case of a single COF defect such as H-Block, it is able to perform the defect analysis by the turn-on voltage supplying circuit by adjusting a resistance value of the corresponding variable resistor, so as to determine the cause of the defect according to a variation of the turn-on voltage caused by adjusting the resistance value of the variable resistor. In addition, it is able to inspect an impaction on a stage of gate driving circuit by a direct current and an after-image by controlling the switching unit to provide or not provide the turn-on voltage to the stage of gate driving circuit. Thus, usability and efficiency of the defect analysis are improved significantly, and the defect may be rapidly determined at a low cost.

Optionally, the turn-on voltage supplying circuit further includes a voltage regulating unit connected between the switching unit and the turn-on voltage inputting terminals of the gate driving circuits, and configured to regulate the turn-on voltages.

The voltage regulating unit may include an operational amplification circuit which may function to supply constant power.

In the following, the turn-on voltage supplying circuit will be described by an example.

Figure 3:
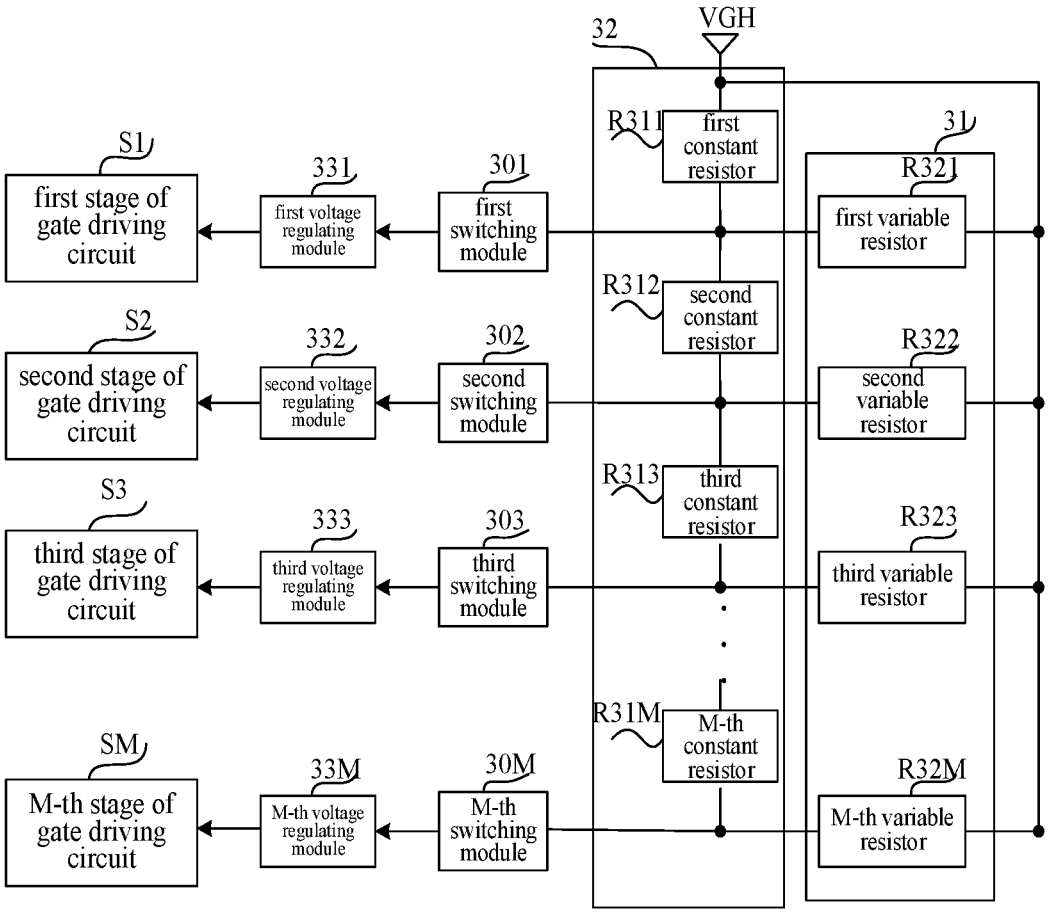
FIG. 3 is a structural schematic diagram of an example of the turn-on voltage supplying circuit according to the embodiments of the present disclosure.

As shown in FIG. 3, the turn-on voltage supplying circuit is configured to provide the turn-on voltages to the M stages of gate driving circuits, where M is an integer greater than 1, and the turn-on voltage supplying circuit includes the voltage supplying unit and the switching unit.

The voltage supplying unit includes a first resistor unit 31 and a second resistor unit 32.

The first resistor unit 31 includes M constant resistors, and the second resistor unit 32 includes M adjustable resistors.

A first constant resistor R311 is connected between the reference turn-on voltage outputting terminal outputting the reference turn-on voltage VGH and a turn-on voltage inputting terminal of a first stage of gate driving circuit S1.

A second constant resistor R312 is connected between the turn-on voltage inputting terminal of the first stage of gate driving circuit S1 and a turn-on voltage inputting terminal of a second stage of gate driving circuit S2.

A third constant resistor R313 is connected between the turn-on voltage inputting terminal of the second stage of gate driving circuit S2 and a turn-on voltage inputting terminal of a third stage of gate driving circuit S3.

An M-th constant resistor R31M is connected between a turn-on voltage inputting terminal of an (M−1)-th stage of gate driving circuit (not shown in FIG. 3) and a turn-on voltage inputting terminal of an M-th stage of gate driving circuit SM.

A first variable resistor R321 is connected between the reference turn-on voltage outputting terminal and the turn-on voltage inputting terminal of the first stage of gate driving circuit S1.

A second variable resistor R322 is connected between the reference turn-on voltage outputting terminal and the turn-on voltage inputting terminal of the second stage of gate driving circuit S2.

A third variable resistor R323 is connected between the reference turn-on voltage outputting terminal and the turn-on voltage inputting terminal of the third stage of gate driving circuit S3.

An M-th variable resistor R32M is connected between the reference turn-on voltage outputting terminal and the turn-on voltage inputting terminal of the M-th stage of gate driving circuit SM.

The switching unit includes M switching modules, including a first switching module 301, a second switching module 302, a third switching module 303, and an M-th switching module 30M as shown in FIG. 3.

The turn-on voltage supplying circuit further includes the voltage regulating unit, which is connected between the switching unit and the turn-on voltage inputting terminals of the M stages of gate driving circuits and configured to regulate the turn-on voltages.

Specifically, the voltage regulating unit includes M voltage regulating modules, each of which is connected to a corresponding switching module and a turn-on voltage inputting terminal of a corresponding stage of gate driving circuit.

A first voltage regulating module 331, a second voltage regulating module 332, a third voltage regulating module 333, and an M-th voltage regulating module 33M are shown in FIG. 3.

In the normal operation, the resistance values of the M variable resistors are all 0 ohms, and the resistance values of the constant resistors R311, the R312, the R313 and the R31M may be determined from the values obtained in the development cycle. For example, resistance values of the constant resistors decrease successively according to a sequence of the M constant resistors, which is especially applicable to the oversized display product, so as to improve the uniformity of colors in the displayed gray-scale image.

In the case of performing the defect analysis process, the resistances of the variable resistors may be adjusted as desired, and the switching unit may also be configured to control a corresponding stage of gate driving circuit to be connected to or disconnected from a corresponding one of the variable resistors, thereby significantly improving capabilities of defect inspection and control adjustment.

Figure 4:
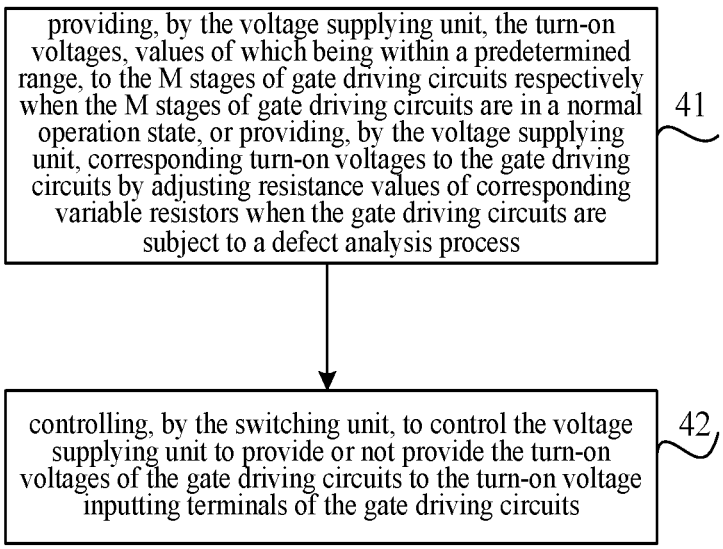
FIG. 4 is a flowchart of a turn-on voltage supplying method according to the embodiments of the present disclosure.

The present disclosure further provides a turn-on voltage supplying method which is applied to the above turn-on voltage supplying circuit. As shown in FIG. 4, the turn-on voltage supplying method includes:

Step 41: providing, by the voltage supplying unit, the turn-on voltages, values of which being within a predetermined range, to the M stages of gate driving circuits respectively when the M stages of gate driving circuits are in a normal operation state, or providing, by the voltage supplying unit, corresponding turn-on voltages to the gate driving circuits by adjusting resistance values of corresponding variable resistors when the gate driving circuits are subject to a defect analysis process, wherein M is an integer greater than 1; and Step 42: controlling, by the switching unit, to control the voltage supplying unit to provide or not provide the turn-on voltages sto the turn-on voltage inputting terminals of the gate driving circuits.

The present disclosure provides in some embodiments the turn-on voltage supplying method, wherein when the M stages of gate driving circuits are in the normal operation state, the voltage supplying unit provides the M stages of gate driving circuits with the turn-on voltages that are substantially equal, so as to improve a uniformity of colors in a displayed image adversely affected by an attenuation of the turn-on voltages of the gate driving circuits due to a long signal transmission distance. In addition, during a process of analyzing a defect of a gate driving circuit, a corresponding turn-on voltage may be provided to the gate driving circuit by the voltage supplying unit by adjusting the resistance value of the corresponding variable resistor, and the switching unit controls the voltage supplying unit to provide or not provide the turn-on voltage of the gate driving circuit to the turn-on voltage inputting terminal of the gate driving circuit. As a result, during the defect analysis process, it is able to reduce the heavy workload for repeating to weld resistors, prevent the product from being damaged by the repeated operations, and facilitate the defect analysis process.

Specifically, the turn-on voltage supplying method further includes regulating the turn-on voltages by a voltage regulating unit.

The present disclosure further provides a turn-on voltage supplying method which is applied to the above turn-on voltage supplying circuit. The method includes: setting resistance values of the constant resistors and the variable resistors, to provide the turn-on voltages, values of which being within the predetermined range, to the M stages of gate driving circuits respectively when the M stages of gate driving circuits are in the normal operation state, or providing the corresponding turn-on voltages to the gate driving circuits when the gate driving circuits are subject to the defect analysis procedure, wherein M is an integer greater than 1

Optionally, the turn-on voltage supplying method may include: when the M stages of gate driving circuits are in the normal operation state, setting each of resistance values of the M variable resistors to be 0 ohm, and setting resistance values of the M constant resistors to enable values of turn-on voltages inputted via the turn-on voltage inputting terminals of the M stages of gate driving circuits to be equal.

In the above optional case, the turn-on voltages provided by the voltage supplying unit to all of the gate driving circuits are equal, so as to prevent the phenomenon of gray-scale flaw in the displayed image from occurring to the maximum extent and optimize the uniformity of the colors in the displayed image.

Specifically, the turn-on voltage supplying method may include: when the n-th stage of gate driving circuit is subject to the defect analysis process, adjusting a resistance value of a corresponding n-th one of the M variable resistors, and detecting a turn-on voltage of the n-th stage of gate driving circuit corresponding to a resistance value of the n-th variable resistor, so as to determine a cause of a defect, wherein n is an integer greater than 0 and equal to or less than M.

The present disclosure further provides in some embodiments a defect analyzing method for analyzing a defect of a gate driving circuit by the turn-on voltage supplying circuit. The defect analyzing method includes: when the gate driving circuit is subject to the defect analysis process, detecting a turn-on voltage corresponding to the gate driving circuit by adjusting a resistance value of a variable resistor connected between the reference turn-on voltage outputting terminal and the turn-on voltage inputting terminal of the gate driving circuit, so as to determine a cause of the defect.

The present disclosure further provides in some embodiments a display device including a display panel and M stages of gate driving circuits, wherein M is an integer greater than 1. In addition, the display device further includes the above turn-on voltage supplying circuit, and the turn-on voltage supplying circuit is configured to provide the turn-on voltages to the M stages of gate driving circuits.

The above are merely the preferred embodiments of the present disclosure. A person skilled in the art may make further modifications and improvements without departing from the principle/spirit of the present disclosure, and these modifications and improvements shall also fall within the scope of the present disclosure.

What is claimed is:

1. A turn-on voltage supplying circuit for providing turn-on voltages to M stages of gate driving circuits, wherein M is an integer greater than 1, the turn-on voltage supplying circuit comprising:

a voltage supplying unit configured to provide the turn-on voltages, values of which being within a predetermined range, to the M stages of gate driving circuits respectively in the case that the M stages of gate driving circuits are in a normal operation state, or provide corresponding turn-on voltages to the gate driving circuits in the case that the gate driving circuits are subject to a defect analysis process; and a switching circuit connected between the voltage supplying unit and turn-on voltage inputting terminals of the gate driving circuits, and configured to control the voltage supplying unit to provide or not provide the turn-on voltages to the turn-on voltage inputting terminals of the gate driving circuits, wherein in the case that the gate driving circuits are subject to the defect analysis process, the voltage supplying unit comprises variable resistors connected between a reference turn-on voltage outputting terminal and the turn-on voltage inputting terminals of the gate driving circuits;

the voltage supplying unit comprises a first resistor unit and a second resistor unit, wherein the first resistor unit comprises M constant resistors, and the second resistor unit comprises M variable resistors, and M is an integer equal to or greater than 4;

a first one of the M constant resistors is connected between the reference turn-on voltage outputting terminal and a turn-on voltage inputting terminal of a first stage of gate driving circuit among the M stages of gate driving circuits;

a second one of the M constant resistors is connected between the turn-on voltage inputting terminal of the first stage of gate driving circuit among the M stages of gate driving circuits and a turn-on voltage inputting terminal of a second stage of gate driving circuit among the M stages of gate driving circuits;

a third one of the M constant resistors is connected between the turn-on voltage inputting terminal of the second stage of gate driving circuit among the M stages of gate driving circuits and a turn-on voltage inputting terminal of a third stage of gate driving circuit among the M stages of gate driving circuits;

an m-th one of the M constant resistors is connected between a turn-on voltage inputting terminal of an (m−1)-th stage of gate driving circuit among the M stages of gate driving circuits and a turn-on voltage inputting terminal of an m-th stage of gate driving circuit among the M stages of gate driving circuits, wherein m is an integer greater than 3 and equal to or less than M;

a first one of the M variable resistors is connected between the reference turn-on voltage outputting terminal and the turn-on voltage inputting terminal of the first stage of gate driving circuit among the M stages of gate driving circuits;

a second one of the M variable resistors is connected between the reference turn-on voltage outputting terminal and the turn-on voltage inputting terminal of the second stage of gate driving circuit among the M stages of gate driving circuits;

an n-th one of the M variable resistors is connected between the reference turn-on voltage outputting terminal and a turn-on voltage inputting terminal of an n-th stage of gate driving circuit among the M stages of gate driving circuits, wherein n is an integer greater than 2 and equal to or less than M;

the second constant resistor is connected directly to both the first constant resistor and the third constant resistor, the first constant resistor is not directly connected to the third constant resistor, the first constant resistor is connected to the third constant resistor via only the second constant resistor and not via any variable resistor, and the first constant resistor is further connected to the third constant resistor via only the first variable resistor and the second variable resistor and not via any constant resistor;

the first variable resistor is connected directly to all of the first constant transistor, the second constant transistor, and the M variable resistors other than the first variable transistor; and the second variable resistor is connected directly to all of the second constant transistor, the third constant transistor, and the M variable resistors other than the second variable transistor.

2. The turn-on voltage supplying circuit according to claim 1, wherein in the case that the M stages of gate driving circuits are in the normal operation state, the voltage supplying unit provides the turn-on voltages, values of which being equal to each other, to the M stages of gate driving circuits respectively.

3. The turn-on voltage supplying circuit according to claim 1, wherein in the case that the M stages of gate driving circuits are in the normal operation state, resistance values of the M variable resistors are all 0 ohm, and resistance values of the M constant resistors are set to enable values of turn-on voltages inputted via the turn-on voltage inputting terminals of the M stages of gate driving circuits to be within the predetermined range.

4. The turn-on voltage supplying circuit according to claim 1, wherein in the case that the n-th stage of gate driving circuit is subject to the defect analysis process, a resistance value of the corresponding n-th variable resistor is adjusted, and a turn-on voltage of the n-th stage of gate driving circuit corresponding to a resistance value of the n-th variable resistor is detected, so as to determine a cause of a defect.

5. The turn-on voltage supplying circuit according to claim 1, further comprising:

a voltage regulating unit connected between the switching circuit and the turn-on voltage inputting terminals of the gate driving circuits, and configured to regulate the turn-on voltages.

6. The turn-on voltage supplying circuit according to claim 5, wherein the voltage regulating unit is an operational amplification circuit.

7. The turn-on voltage supplying circuit according to claim 1, wherein the turn-on voltages are capable of enabling the gate driving circuits to operate normally.

8. The turn-on voltage supplying circuit according to claim 3, wherein resistance values of the M constant resistors are distributed in a successively decreasing manner according to a sequence of the M constant resistors.

9. A turn-on voltage supplying method for the turn-on voltage supplying circuit according to claim 1, wherein the method comprises:

providing, by the voltage supplying unit, the turn-on voltages, values of which being within the predetermined range, to the M stages of gate driving circuits respectively in the case that the M stages of gate driving circuits are in the normal operation state, or providing, by the voltage supplying unit, the corresponding turn-on voltages to the gate driving circuits by adjusting the resistance values of the corresponding variable resistors in the case that the gate driving circuits are subject to the defect analysis process, wherein M is an integer greater than 1; and controlling, by the switching circuit, to control the voltage supplying unit to provide or not provide the turn-on voltages to the turn-on voltage inputting terminals of the gate driving circuits.

10. The method according to claim 9, further comprising: regulating the turn-on voltages by a voltage regulating unit.

11. A turn-on voltage supplying method for the turn-on voltage supplying circuit according to claim 1, wherein the method comprises:

setting resistance values of the constant resistors and the variable resistors, to provide the turn-on voltages, values of which being within the predetermined range, to the M stages of gate driving circuits respectively in the case that the M stages of gate driving circuits are in the normal operation state, or providing the corresponding turn-on voltages to the gate driving circuits in the case that the gate driving circuits are subject to the defect analysis procedure, wherein M is an integer greater than 1.

12. The method according to claim 11, further comprising:

in the case that the M stages of gate driving circuits are in the normal operation state, setting each of resistance values of the M variable resistors to be 0 ohm, and setting resistance values of the M constant resistors to enable values of turn-on voltages inputted via the turn-on voltage inputting terminals of the M stages of gate driving circuits to be equal.

13. The method according to claim 11, further comprising:

in the case that the n-th stage of gate driving circuit is subject to the defect analysis process, adjusting a resistance value of the corresponding n-th variable resistor, and detecting a turn-on voltage of the n-th stage of gate driving circuit, so as to determine a cause of a defect, wherein n is an integer greater than 0 and equal to or less than M.

14. A defect analyzing method for analyzing a defect of a gate driving circuit by the turn-on voltage supplying circuit according to claim 1, wherein the method comprises:

in the case that the gate driving circuit is subject to the defect analysis process, detecting a turn-on voltage of the gate driving circuit by adjusting a resistance value of a variable resistor connected between the reference turn-on voltage outputting terminal and the turn-on voltage inputting terminal of the gate driving circuit, so as to determine a cause of the defect.

15. A display device comprising:

M stages of gate driving circuits, wherein M is an integer greater than 1; and the turn-on voltage supplying circuit according to claim 1, wherein the turn-on voltage supplying circuit is configured to provide the turn-on voltages to the M stages of gate driving circuits.

16. The display device according to claim 15, wherein in the case that the M stages of gate driving circuits are in the normal operation state, the voltage supplying unit provides the turn-on voltages, values of which being equal to each other, to the M stages of gate driving circuits respectively.

17. The display device according to claim 15, wherein in the case that the M stages of gate driving circuits are in the normal operation state, resistance values of the M variable resistors are all 0 ohm, and resistance values of the M constant resistors are set to enable values of turn-on voltages inputted via the turn-on voltage inputting terminals of the M stages of gate driving circuits to be within the predetermined range.

18. The display device according to claim 15, wherein in the case that the n-th stage of gate driving circuit is subject to the defect analysis process, a resistance value of the corresponding n-th variable resistor is adjusted, and a turn-on voltage of the n-th stage of gate driving circuit corresponding to a resistance value of the n-th variable resistor is detected, so as to determine a cause of a defect.

* * * * *